United States Patent [19]

Chuan

[11] Patent Number: 4,804,099

[45] Date of Patent: Feb. 14, 1989

[54] BOTTLE CLOSURE SYSTEM

[76] Inventor: Chang C. Chuan, No. 32, Ching An Hsing Tswen, Ta Pwu Rd. Chi An Village, Jwei Fang Town, Taiwan

[21] Appl. No.: 113,483

[22] Filed: Oct. 28, 1987

[51] Int. Cl.[4] ..... B65D 39/00

[52] U.S. Cl. ..... 215/279

[58] Field of Search ..... 215/287, 294, 279

[56] References Cited

U.S. PATENT DOCUMENTS

| | | | |
|---|---|---|---|
| 676,089 | 6/1901 | Heath | 215/279 |
| 759,154 | 5/1904 | Brewington | 215/279 |
| 907,091 | 12/1908 | Ricke | 215/279 |

*Primary Examiner*—Donald F. Norton

*Attorney, Agent, or Firm*—Morton J. Rosenberg

[57] ABSTRACT

The present invention pertains to a closure system 10 including a bottle cap and a bottle neck portion 20 and in particular, denotes the use of a flexible pressing spring 21 for reversible insert into both the bottle neck 20 and the bottle cap. Such insert and joined motion between the mating portions allows the opening and closing of the bottle cap to be a simple task. The closure system 10 produces an aesthetically pleasing sound effect at the time of the opening of the bottle. The head of the bottle cap and closure system 10 may be formed into various contours and the neck of the bottle body, as well as the closure system may be integrally formed as well as being independently made and then matched with the neck of standard bottles.

1 Claim, 4 Drawing Sheets

BOTTLE CLOSURE SYSTEM

BACKGROUND OF THE INVENTION

The subject invention pertains to a closure system including a cap member and a cap body for insertion into a bottle body container. In use, the closure system may produce a pleasingly aesthetic sound effect during an opening procedure similar in nature to the audio presentation when a bottle of champagne is opened. The manufacturing process of the aforementioned bottle closure system is simple in construction having low production costs leading to an economical completed and manufactured system. Additionally, the closure system of the subject invention is sanitary.

In prior art, an opening mechanism has to be applied to open the cap of a conventional or prior art glass bottle. Such has caused problem areas in the past, in that the user may need some additional strength to open the bottle. The opener further may become rusty or otherwise deteriorate. Other prior art examples of opening methods allow for opening by threaded securement between prior art bottle caps and threaded bottle necks. Although this is more convenient than the use of an opening mechanism, some strength is needed to open such prior art systems. In such prior art opening and closing systems, a tooth-shaped impression of the bottle caps has caused injury to the user's hand during the opening or closing procedure.

DETAILED DESCRIPTION OF THE PREFERRED EMBODIMENT

Figure 1:
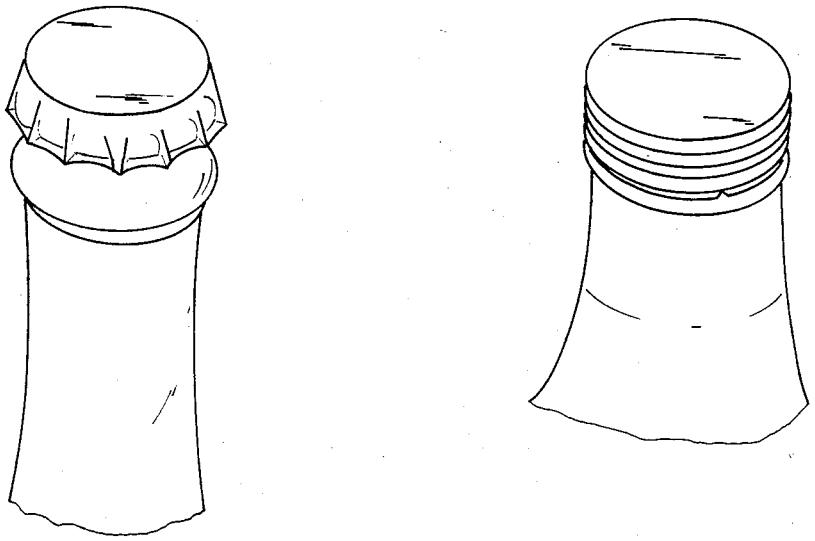
FIG. 1 is a perspective view of prior art closure systems for bottle containers.

Referring now to FIG. 1, there is shown conventional or prior art bottle caps on conventional or prior art bottle containers. In one known form, the bottle cap must be pried open from the bottle neck by use of an opening mechanism. In the other form, the bottle cap is threadedly secured to the bottle neck. In both of these conventional prior art closing systems, the cap after having been opened and removed from the bottle neck, may not be easily closed in tight relation to the bottle neck. In cases where the contents of the bottle are a pressurized liquid, it has been found difficult to maintain the pressurization in its original condition and quality. Additionally, in threaded securement type closure systems, a twisting or unthreading of the cap will break a tooth-shaped impression which may bring jagged pieces of metal into contact with the user, thus causing injury. Additionally, the external appearance of such prior bottle closure systems are generally not aesthetically pleasing.

Referring now to FIGS. 2A–2F, there is shown the bottle closure system of the subject invention concept which includes bottle cap 10 matingly engaged with a bottle neck portion 20 of a bottle container. Bottle cap 10 includes bottle cap head section 11 and bottle cap body 12. Bottle cap head 11 may be formed in varying contours in accordance with cultural requirements or standards which may be aesthetically pleasing to the user.

Bottle neck 20 is standardly formed with an interior hollow through opening within which bottle cap 10 is matingly and contiguously inserted on an inner wall thereof. Body 12 of bottle cap 10 includes an interior hollow body section, as is shown in FIG. 2C. At a predetermined location on an exterior wall of body 12 of bottle cap 10, there is formed notch 121 which extends around a peripheral circumferential section of an external wall of body 12.

Bottle neck portion 20 has an interior bore which matches compactly with the exterior wall diameter of body 12 of bottle cap 10.

Figure 2A:
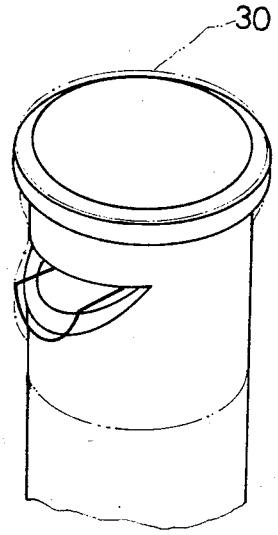
FIG. 2A is a perspective view of the closure system of the subject invention concept showing such applied to a bottle neck.
Figure 2B:
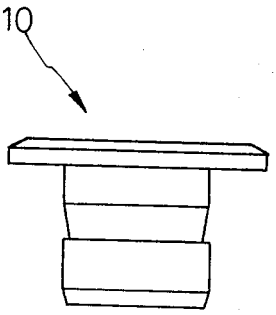
FIG. 2B is an elevational view of a bottle cap of the subject invention concept.
Figure 2C:
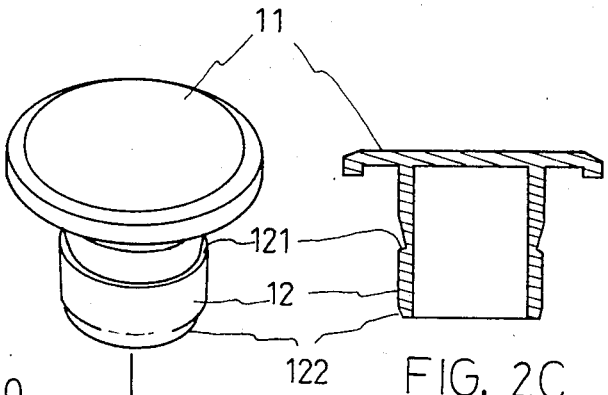
FIG. 2C is a cross-sectional view of the bottle cap of the subject invention concept.
Figure 2D:
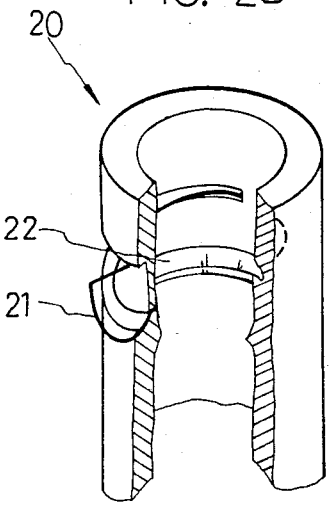
FIG. 2D is a perspective view partially cut-away of the bottle neck portion of the subject closure system invention concept.
Figure 2E:
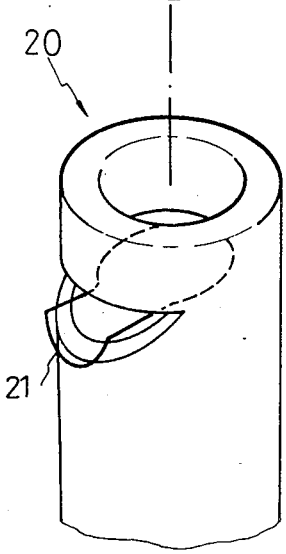
FIG. 2E is an exploded perspective view of the closure system of the subject invention concept.
Figure 2F:
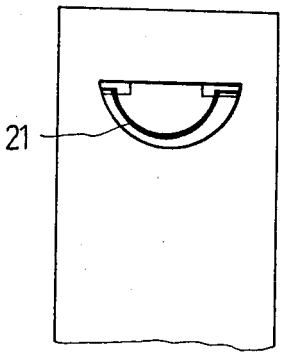
FIG. 2F is an elevational view showing the spring member inserted within an opening of the bottle neck of the subject invention concept.

Flexible pressing spring 21 clearly seen in FIG. 2D and FIG. 2E, extends external bottle neck 20 through an opening formed in a sidewall thereof. Flexible spring 21 is ring-shaped in contour and is insertable within inverted groove formed within bottle neck portion 20. In this manner, spring 21 may be pushed into the groove formed within bottle neck 20 as is seen in FIG. 3D to allow release of bottle cap 10 from bottle neck 20.

Figure 3A:
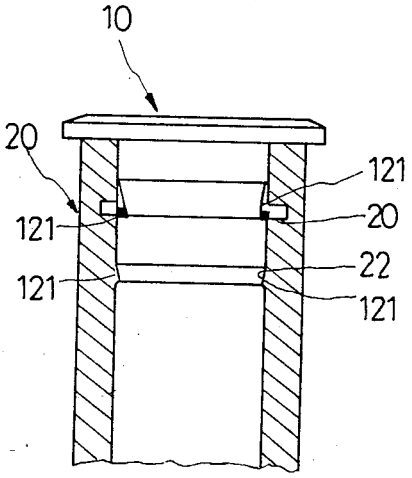
FIG. 3A is a cross-sectional view of the closure system of the subject invention concept showing the bottle cap member in locked constrainment within a bottle neck portion of a bottle container.
Figure 3B:
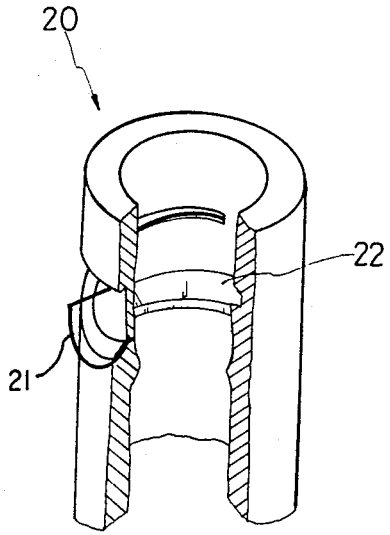
FIG. 3B is a perspective cut-away view of the bottle neck portion showing a spring member in an unlocked position.
Figure 3C:
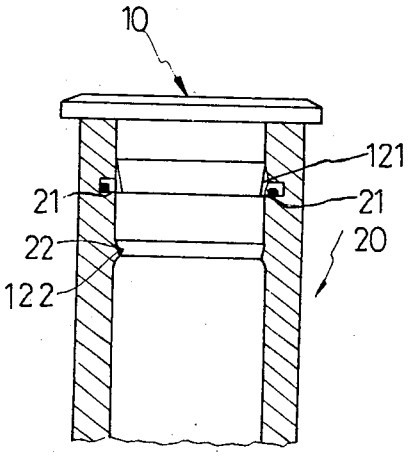
FIG. 3C is a cross-sectional view of the bottle neck of the subject invention concept showing the spring member providing an unlocked positional location to allow removal of the bottle cap; and, FIG. 3D is a perspective cut-away view of the bottle neck portion showing the spring member being inserted in an unlocked position.
Figure 3D:
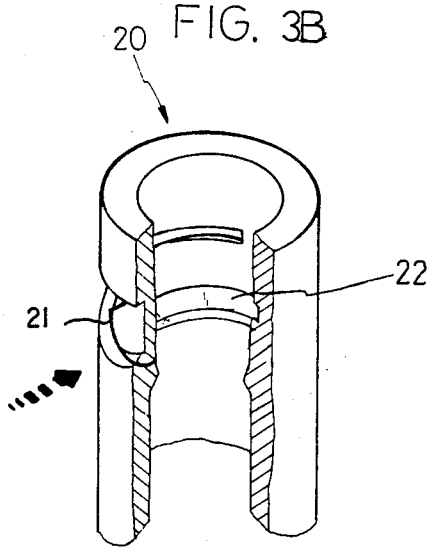

Additionally, flexible spring member 21 may be pulled laterally away from an outer surface of bottle neck 20, as is shown in FIG. 3B for insertion of spring 21 within notch 121 of bottle cap 10 to provide a locking effect of bottle cap 10 to bottle neck 20 providing the closure system of the subject invention concept.

Additionally, bottle neck 20 includes an internal inclined ring section 22 extending radially inwardly within the bore of bottle neck 20. Inclined portion 122 of bottle cap 10 matingly engages inclined ring member 22 to provide an air-tight effect for the closure system of the subject invention concept.

Simultaneously at the time of the subject closure system being manufactured, a covering film 30, as is shown in FIG. 2A, may be provided over the bottle cap and bottle neck combination to provide additional closure in order that the combined system be maintained in a sanitary condition. The aforementioned film 30 may be torn at the time of initial opening of the closure system.

In operation, as shown in FIG. 3A–3D, when the closure system is to be opened, flexible spring 21 may be pressed inwardly toward the outer wall of bottle neck 20. Through this displacement, spring 21 is inserted into the groove formed in the internal wall of bottle neck portion 20 to allow bottle cap 10 to be removed from bottle neck 20.

When bottle cap 10 is to be closed on bottle neck 20, bottle cap 10 is inserted into the bore of bottle neck 20 which displaces spring 21 in a laterally outward direction from bottle neck 20 and spring 21 is displaced into engagement within notch 121. Additionally, spring 21 may be pulled laterally outward from neck portion 20 to provide the proper spring-notch insert.

Additionally, it has been found that due to the fact that cap body 12 is hollow, such produces an aesthetically pleasing sound effect at the time when the bottle is being opened much in the context of a champagne bottle being opened.

If the liquid contained within the bottle container is pressurized, the automatic springing up of bottle cap 10 produces a sound aesthetically pleasing to the user's ear.

Bottle cap body 12 and bottle cap 11 of bottle cap 10 may be formed in an integral manner. Since the head 11 of the bottle of bottle cap 10 may be made in differing contours, such may be formed in aesthetically pleasing manners. Additionally, bottle neck portion 20 and bottle body 12 may either be integrally formed or manufactured independently each from the other to interface with the neck of an ordinary prior art bottle container. Thus, such may become a replaceable bottle neck to increase its utilization.

In general, the invention concept closure system may be formed of a plastic material which allows it to be free of rust and flexible so that it is not brittle and provides for an easy manufacturing process with low production costs and further provides a simple way of opening and closing a bottle cap to a bottle neck having an aesthetically pleasing sound effect.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

I claim:

1. A bottle closure system including a bottle cap and a bottle having a neck portion, comprising:

a bottle cap head which may be formed into a variety of external contours;

a bottle cap body formed integrally with said bottle cap head, said bottle cap body having a hollow interior and a notch formed in an outer sidewall of said bottle cap body, said notch passing throughout a circumference of said sidewall; and, a flexible spring member extending through an opening formed in said bottle neck portion for (1) insert into and out of a groove formed within an interior wall of said bottle neck portion, and, (2) insert into and out of said notch formed in said cap body when said cap body is inserted into said bottle neck portion.

* * * * *